United States Patent [19]

Kawaguchi et al.

[11] Patent Number: 4,590,870

[45] Date of Patent: May 27, 1986

[54] APPARATUS FOR CONTINUOUSLY FORMING STITCHES ON A PLURALITY OF SEWING PORTIONS

[75] Inventors: Hideo Kawaguchi; Hideo Ando; Yasuhiko Watanabe, all of Nagoya, Japan

[73] Assignee: Brother Kogyo Kabushiki Kaisha, Nagoya, Japan

[21] Appl. No.: 787,239

[22] Filed: Oct. 15, 1985

[30] Foreign Application Priority Data

Oct. 17, 1984 [JP] Japan ..... 59-217691

[51] Int. Cl.[4] ..... D05B 3/04

[52] U.S. Cl. ..... 112/70

[58] Field of Search ..... 112/67, 70, 65

[56] References Cited

U.S. PATENT DOCUMENTS

| | | | |
|---|---|---|---|
| 2,899,919 | 8/1959 | Myska | 112/67 |
| 2,906,217 | 9/1959 | Myska | 112/67 |
| 3,884,164 | 5/1975 | Nakamura | 112/70 |
| 3,911,838 | 10/1975 | Nolli | 112/70 |
| 4,131,074 | 12/1978 | Riss | 112/121.14 |
| 4,181,083 | 1/1980 | Bajer et al. | 112/70 |

*Primary Examiner*—H. Hampton Hunter

*Attorney, Agent, or Firm*—Jordan and Hamburg

[57] ABSTRACT

The invention is concerned with a sewing apparatus having a sewing machine mounted on a work table, fabric workpiece clamping means capable of holding and releasing the fabric workpiece on the work table, and a feed driving mechanism for intermittently feeding the fabric workpiece clamping means, whereby machine sewing and fabric workpiece feed are repeated alternatingly thereby sewing buttons or forming buttonhole stitches to a plurality of sewing portions on the fabric workpiece. The sewing apparatus has auxiliary fabric workpiece clamping means operable independently of the fabric workpiece clamping means. In the case of processing of a long fabric workpiece, when the required amount of feed of the fabric workpiece exceeds the allowed stroke of the fabric workpiece clamping means between the feed start position and the maximum feed position, control means operate to allow the fabric workpiece clamping means to release the fabric work piece after the fabric workpiece is retained by the auxiliary fabric workpiece clamping means and to return towards the feed start position where the fabric workpiece clamping means again retain the fabric workpiece.

12 Claims, 7 Drawing Figures

APPARATUS FOR CONTINUOUSLY FORMING STITCHES ON A PLURALITY OF SEWING PORTIONS

BACKGROUND OF THE INVENTION

1. Field of the Invention

The present invention relates to a sewing apparatus which is adapted for alternatingly repeating machine sewing and intermittent fabric workpiece feed such as to continuously sew buttons or form stitches for buttonholes on a plurality of fabric workpieces having different sizes.

2. Description of the Prior Art

Examples of sewing apparatus of the kind mentioned above are shown in U.S. Pat. Nos. 2,899,919, 2,906,217 and 4,131,074. Each of these known apparatus is provided with a fabric workpiece clamping member which selectively retaines and releases the fabric workpiece on a work table. The fabric workpiece clamping member intermittently moves on the work table such as to intermittently feed the fabric workpiece, thereby bringing sewing portions successively to the position where the sewing needle operates.

In these known sewing apparatus, the length of the work table and the allowable stroke of the fabric workpiece clamping member are set optimumly for the length of, for example, shirts which are processed most commonly. In order that stitches are continuously formed on long fabric workpieces such as long dresses, white robes, negligees and so forth, it is necessary that the length of the work table and the allowable stroke of the fabric workpiece clamping member be increased correspondingly, resulting in an increase of the size of apparatus as a whole.

SUMMARY OF THE INVENTION

Accordingly, an object of the invention is to provide a novel sewing apparatus which is capable of continuously forming stitches on a plurality of sewing portions of long fabric workpieces in short time without requiring any increase of the size of apparatus as a whole.

Another object of the invention is to provide an apparatus which is easy to handle and which is capable of automatically judging whether the required amount of feed of the fabric workpiece exceeds the allowable stroke of a fabric workpiece clamping member.

Another object of the invention is to provide a sewing apparatus in which, when the fabric workpiece clamping member is returned to a feed start position after sewing of a long fabric workpiece to an intermediate portion, the front and rear ends of the fabric workpiece are held by a pair of auxiliary fabric workpiece clamping members such that the offsetting of sewing portions is avoided.

Still another object of the invention is to provide a mechanism which is capable of automatically and promptly delivery the fabric workpiece after sewing.

A further object of the invention is to provide a sewing apparatus wherein the delivery mechanism mentioned above also serves as the auxiliary fabric workpiece clamping member for holding the front end of the fabric workpiece, thereby accurately and continuously forming stitches on a plurality of sewing portions on a long fabric workpiece.

To these ends, according to the invention, there is provided a sewing apparatus comprising: a work table; a sewing machine adapted to sew buttons on a fabric workpiece on the work table or to form buttonhole stitches on the fabric workpiece; fabric workpiece clamping means movable along the upper surface of the work table and capable of holding and releasing the fabric workpiece; a feed driving mechanism adapted to bring the clamping means from a feed start position to a maximum feed position such as to bring a plurality of sewing portions of the fabric workpiece succesively to a reciprocating path of a needle of the sewing machine; auxiliary fabric workpiece clamping means capable of holding and releasing the fabric workpiece on the work table independently of the fabric workpiece clamping means; detecting means adapted for detecting a forward travel of the fabric workpiece clamping means from the feed start position to an instant position; memory means for storing data concerning the number of the sewing portions and the intervals thereof; and control means for controlling the fabric workpiece clamping means and the auxiliary fabric workpiece clamping means such that, when the sum of the forward travel of the fabric workpiece clamping means and the interval between successive sewing portions exceeds an allowed stroke of the fabric workpiece clamping means from the feed start position to the maximum feed position, the fabric workpiece clamping means once release the fabric workpiece and return from the instant position towards the feed start position while the auxiliary fabric workpiece clamping means hold the fabric workpiece and then hold the fabric workpiece again at a returned position thereof.

In a specific form of the invention, the apparatus comprises delivery means disposed at a position ahead of the reciprocating path of the needle of the sewing machine as viewed in the direction of feed of the fabric workpiece, such as to be able to move reciprocatingly between a first position where it contacts the fabric workpiece on the work table and a second position spaced from the first position, the delivery means being adapted to deliver, when it is in the first position, the fabric workpiece to the outside of the work table after the stitches have been formed on all the sewing portions. The arrangement is such that, when the auxiliarv fabric workpiece clamping member retaines the rear end of the fabric workpiece, the delivery means come down to the first position such as to retain the front end of the fabric workpiece.

DETAILED DESCRIPTION OF THE PREFERRED EMBODIMENT

A button sewing apparatus as an embodiment of the invention will be described hereinunder with reference to the accompanying drawings.

Figure 1:
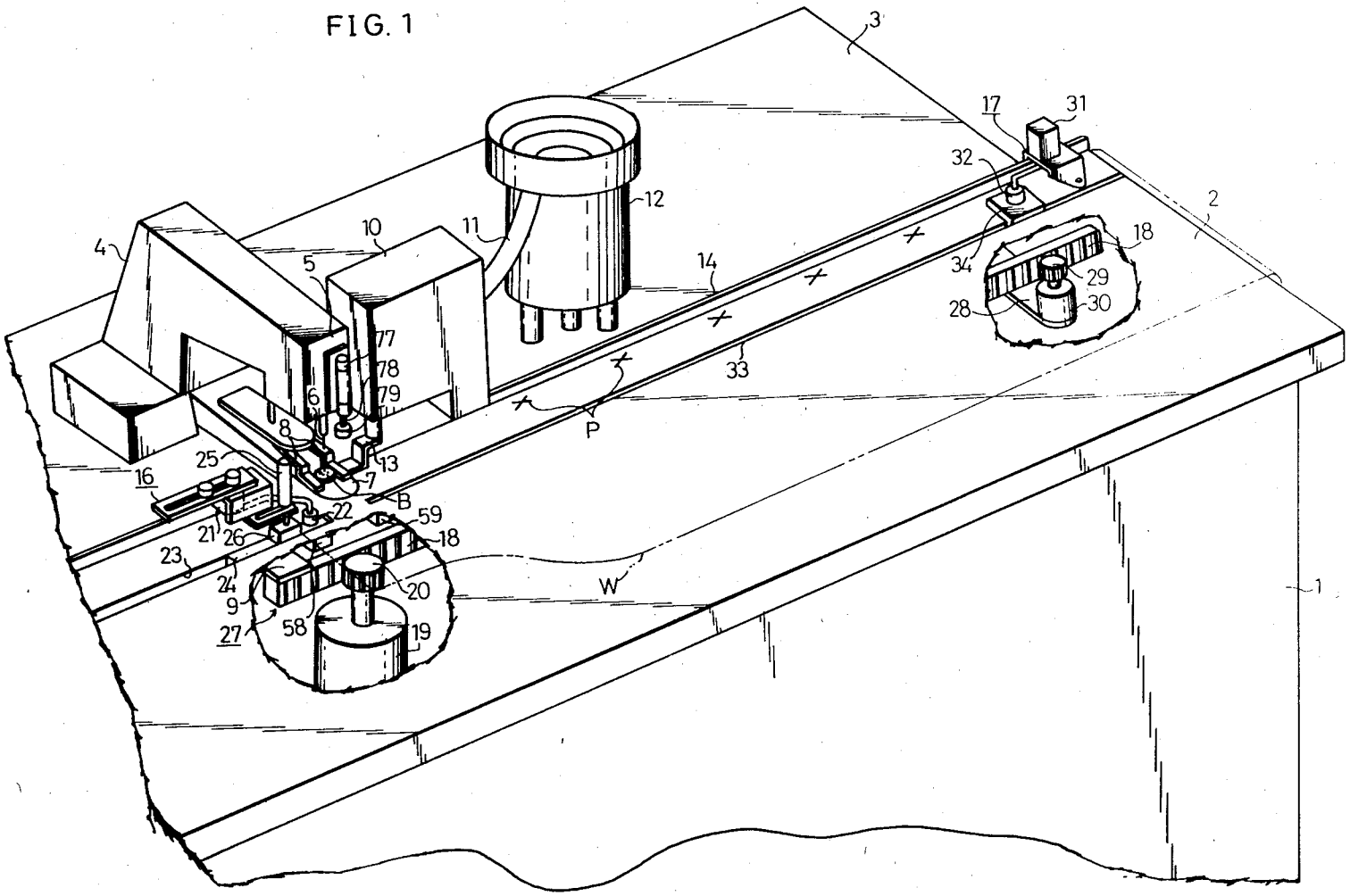
FIGS. 1 and 2 are perspective views of right-hand side portion and a left-hand side portion of a button sewing machine embodying the present invention.

As will be seen from FIG. 1, the sewing apparatus has a frame 1 which fixedly carries a work table 2 extending from the left to the right and also a machine table 3 behind the work table 2. The machine table 3 carries a sewing machine 4 which has an arm portion 5. The arm portion 5 supports a sewing needle 6 vertically movably. A pair of button clamping arms 8, which also play the role of fabric workpiece clamping members, are arranged above a bed surface 7 in such a manner to oppose each other across the needle 6. The button clamping arms 8 are mounted for open and close actions, as well as for vertical and lateral movements. In the operation of the sewing machine 4, the needle 6 and the button clamping arms 8 cooperate with each other such as to sew the buttons B on sewing portions P of the fabric workpiece W in each of the successive sewing cycles. The bed surface 7 of the sewing machine 4 is flush with the upper surface of the work table 2. The length of the work table 2 is set optimumly for the length of a shirt which is processed most frequently.

A button supplying device 10 is situated on the machine table 3 adjacent the sewing machine 4 on the right side of the latter. The button supplying device 10 rotatably carries at its portion adjacent the sewingmachine 4 a button supplying arm 13. A button hopper 12 is provided on a portion of the machine table 3 adjacent the button supplying device 10. The button hopper 12 is connected to the button supplying device 10 through a flexible pipe 11. The buttons B discharged from the button hopper 12 are supplied in one-by-one fashion to the button clamping arms 8 through the button supplying arm 13. A limiting piece 14 provided on the rear edge of the work table 2 guides the rear edge of the fabric workpiece W. As will be seen from FIG. 2, an operation panel 15 is provided on the left end of the machine table 3.

Figure 3:
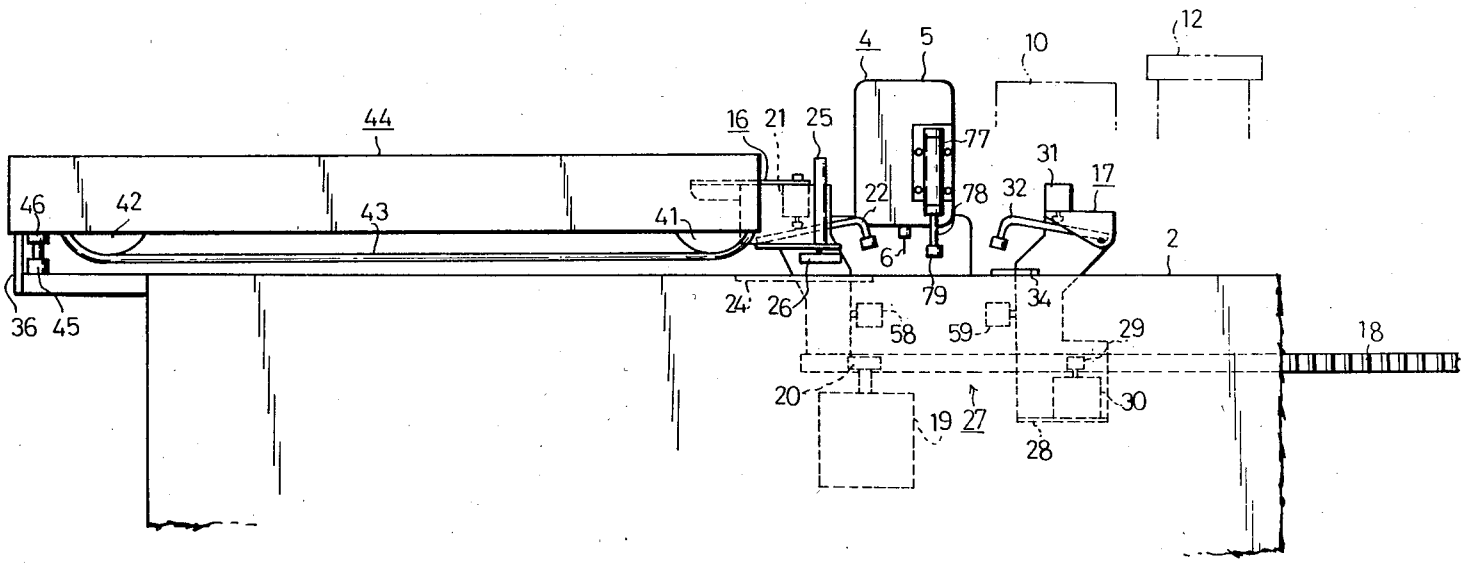
FIG. 3 is a fragmentary front elevational view of the sewing apparatus illustrating the positions of the members for clamping and holding the front and rear ends of a fabric workpiece in the state of initial setting.

As will be seen from FIGS. 1 and 3, a feed drive mechanism 27 is disposed on a rear portion of the work table 2 on both the left and right sides of the sewing machine 4. The feed drive mechanism 27 includes a fabric workpiece front end clamping member 16 disposed on the left side of the sewing machine 4 and a fabric workpiece rear end clamping member 17 disposed on the right side of the sewing machine 4. The front end clamping member 16 is movable to the left and right along a rail member (not shown) in the frame 1. A rack 18 serving as a connecting member extending in the left and right directions in the frame 1 is connected at its left end to the front end clamping member 16 through a mounting bracket 9. The rack 18 is supported for movement in the longitudinal direction of the frame 1. A first pulse motor 19 fixed to the frame 1 has a pinion 20 which engages with a part of the rack 18. The arrangement is such that the front end clamping member 16 is moved to the left and right integrally with the rack 18 in accordance with the forward and backward rotation of the first pulse motor 19.

The front end clamping member 16 has a front end clamp 22 adapted to be rotated up and down by a first clamp cylinder 21, and a lower clamp member 24 which is slidably received in a groove 23 formed in a left side portion of the work table 2 such as to extend to the left and right. The front end clamp 22 and the lower clamp member 24 is adapted to cooperate with each other in holding and releasing the front end portion of the fabric workpiece W. The front end clamping member 16 has a front end stopper 26 adapted to be moved up and down by means of the stopper cylinder 25. When the fabric workpiece W is set, the front end stopper 26 is lowered onto the lower clamp member 24 such as to position the front edge of the fabric workpiece W.

On the other hand, the rear end clamping member 17 has a rear end clamp 32 adapted to be rotated up and down by a second clamp cylinder 31 and a lower clamp plate 34 which is movable along a groove 33 formed in the right side portion of the work table 2 such as to extend in the left and right directions. The rear end clamp 32 and the lowerclamp plate 34 are adapted to cooperate with each other in clamping and releasing the rear end of the fabric workpiece W. The rear end clamping member 17 has a motor mounting plate 28 which is disposed within the frame 1. A second pulse motor 30 is mounted on the motor mounting plate 28. The second pulse motor 30 has an output shaft carrying a pinion 29 which meshes with the rack 18.

When the second pulse motor 30 is stopped, the rear end clamping member 17 is held on the rack 18 by virtue of the engagement between the pinion 29 and the rack 18. When the first pulse motor 19 is started while the second pulse motor 30 is not operating, the front end clamping member 16 and the rear end clamping member 17 are moved integrally with each other in accordance with the movement of the rack 18, so that a plurality of sewing portions are brought to the reciprocating path of the needle of the sewing machine 4 successively and intermittently. Conversely, when the second pulse motor 30 is started while the first pulse motor 19 is not operating, only the rear end clamping member 17 moves along the rack 18.

Figure 2:
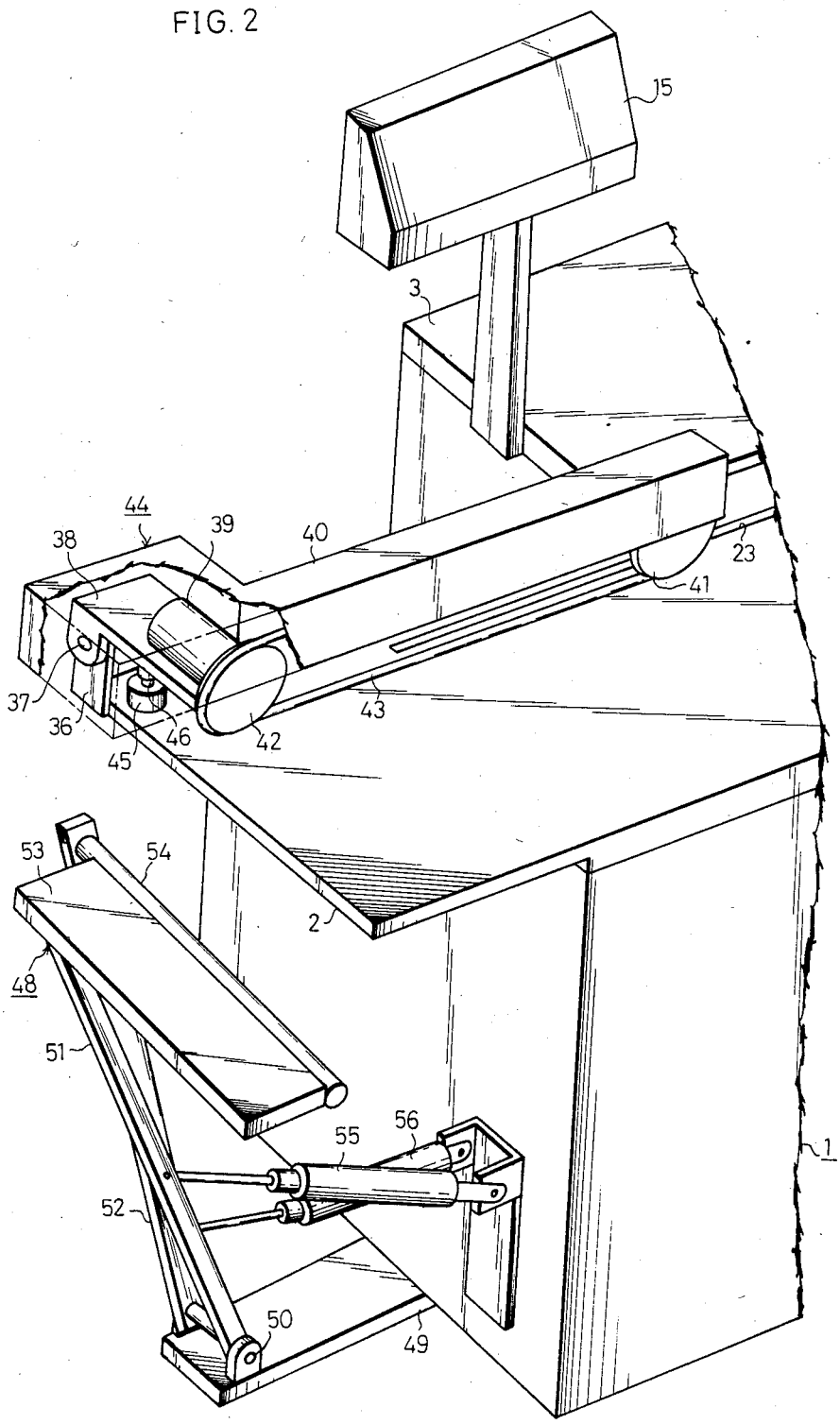

As shown in FIG. 2, an delivery device 44 for delivery the fabric workpiece W fed by the feed drive mechanism 27 is provided on the top of a left portion of the work table 2. A motor mounting plate 38 is supported vertically movably by the left rear end of the work table 2 through a supporting bracket 36 and a supporting shaft 37. An delivery motor 39 mounted on the motor mounting plate 38 has an output shaft to which is fixed a driving pulley 42. A cover 40 is fixed to the motor mounting plate 38 such as to extend towards the sewing machine 4. A driven pulley 41 is rotatably housed in the right end portion of the cover 40. A belt 43 as a delivery means is interposed between the driving pulley 42 and the driven pulley 41.

A lifting cylinder 45 on the work table 2 has a piston rod 46 the upper end of which is held in contact with the lower surface of the motor mounting plate 38. When the fabric workpiece W is being fed by means of the clamping members 16 and 17, the delivery motor 39 is kept inoperative and the piston rod 46 of the lifting cylinder 45 is in the projected position. In consequence, the motor mounting plate 38 is rotated upwardly and the delivery belt 43 is kept away from the upper surface of the work table 2. After the completion of the sewing of, the button on the last sewing portion P on the fabric workpiece W following the completoin of the feed by the clamping members 16, 17, the piston rod 46 of the lifting cylinder 45 is retracted so that the lower portion of the delivery belt 43 falls onto the fabric workpiece W. As the delivery motor 39 is started from this state, the delivery belt 43 revolves so that the fabric workpiece W is delivered from the worktable 2.

A stacking device 48 for stacking the thus delivered fabric workpieces W is disposed under the work table 2 on the left side of the frame 1. The frame 1 is provided with a supporting plate 49 projecting to the left from the lower end thereof. A first supporting rod 51 and a second supporting rod 52 are rotatably mounted on the upper side of the end of the supporting plate 49, through a shaft 50. A tabular mounting table 53 is secured to the upper end of the first supporting rod 51 such as to extend horizontally and forwardly therefrom. A clamping bar 54 fixed to the upper end of the second supporting rod 52 extends substantially at the same level as the mounting table 53 and in parallel therewith.

A first rocking cylinder 55 is interposed between the supporting rod 51 and the frame 1. The mounting table 53 is adapted to be driven by a first rocking cylinder 55 to the left and right between two positions across the path of the fabric workpiece W which falls by the force of gravity after being delivered by the delivery device 44. A second rocking cylinder 56 is interposed between the second supporting rod 52 and the frame 1. The clamping bar 54 is adapted to be driven by the second rocking cylinder 56 to the left and right between a position where it contacts the right side surface of the mounting table 53 and another position spaced from the first-mentioned position. When the fabric workpiece W has been suspended a predetermined length, the clamping bar 54 operates such as to retain the fabric workpiece W onto the mounting table 53, thus determining the bending position of the fabric workpiece W. As the mounting table 53 and the clamping bar 54 rock together, the fabric workpiece W delivered from the delivery device 44 is stacked on the mounting table 53.

As will be seen from FIGS. 1 and 3, a feed start position detecting switch 58 is disposed in the frame 1 between the needle 6 of the sewing machine 4 and the front end clamping member 16. The switch 58 is adapted to be turned on and off by the engagement and disengagement with and from the front end clamping member 16 which has been displaced to the right. As this switch is turned on, a signal is issued to stop the driving of the first pulse motor 19, thus determining a feed start position of the clamping member 16. A maximum feed position detecting switch 59 is fixed in the frame 1, between the needle 6 of the sewing machine 4 and the rear end clamping member 17. This switch 59 is adapted to be turned on and off by the engagement and disengagement with and from the rear end clamping member 17 which has been moved leftward. As the switch 59 is turned on, a signal is produced such as to stop the operation of the first pulse motor 19, thus determining a maximum feed position of the clamping members 16, 17. In consequence, the fabric workpiece clamping members 16, 17 are moved reciprocally within an allowed feed stroke between the feed start position and the maximum feed position mentioned above. The allowed feed stroke is determined in accordance with the length of the shirt.

On the front side of the arm portion 5 of the sewing machine 4 is fixed an auxiliary fabric workpiece clamping cylinder 77 which constitutes a part of the auxiliary fabric workpiece clamping means. A retainer 79 made of a plastic is fixed to the lower end of the piston rod 78. In the case of sewing of a comparatively short fabric workpiece W such as a shirt, the piston rod 78 is retracted so that the retainer 79 is held at a position which is spaced upwardly from the workpiece W. In contrast, in the case where the button is to be sewed on a comparatively long fabric workpiece such as a white robe, long dress or a negligee, if both fabric workpiece clamping members 16, 17 have been moved to the maximum feed position, the piston rod 78 of the auxiliary fabric workpiece clamping cylinder 77 is projected such as to retain the fabric workpiece W near the needle dropping position onto the work table 2, thus holding the fabric workpiece W.

The delivery belt 43 of said delivery device 44 constitutes another portion of the auxiliary fabric workpiece clamping means. When the piston rod 78 of the auxiliary fabric workpiece clamping cylinder 77 is extended during sewing of a long fabric workpiece W, the piston rod 46 of the lifting cylinder 45 is retracted in synchronism with the extension of the piston rod 78, so that the delivery belt 43 retaines and holds the front end of the workpiece W on the upper surface of the work table 2.

Figure 6:
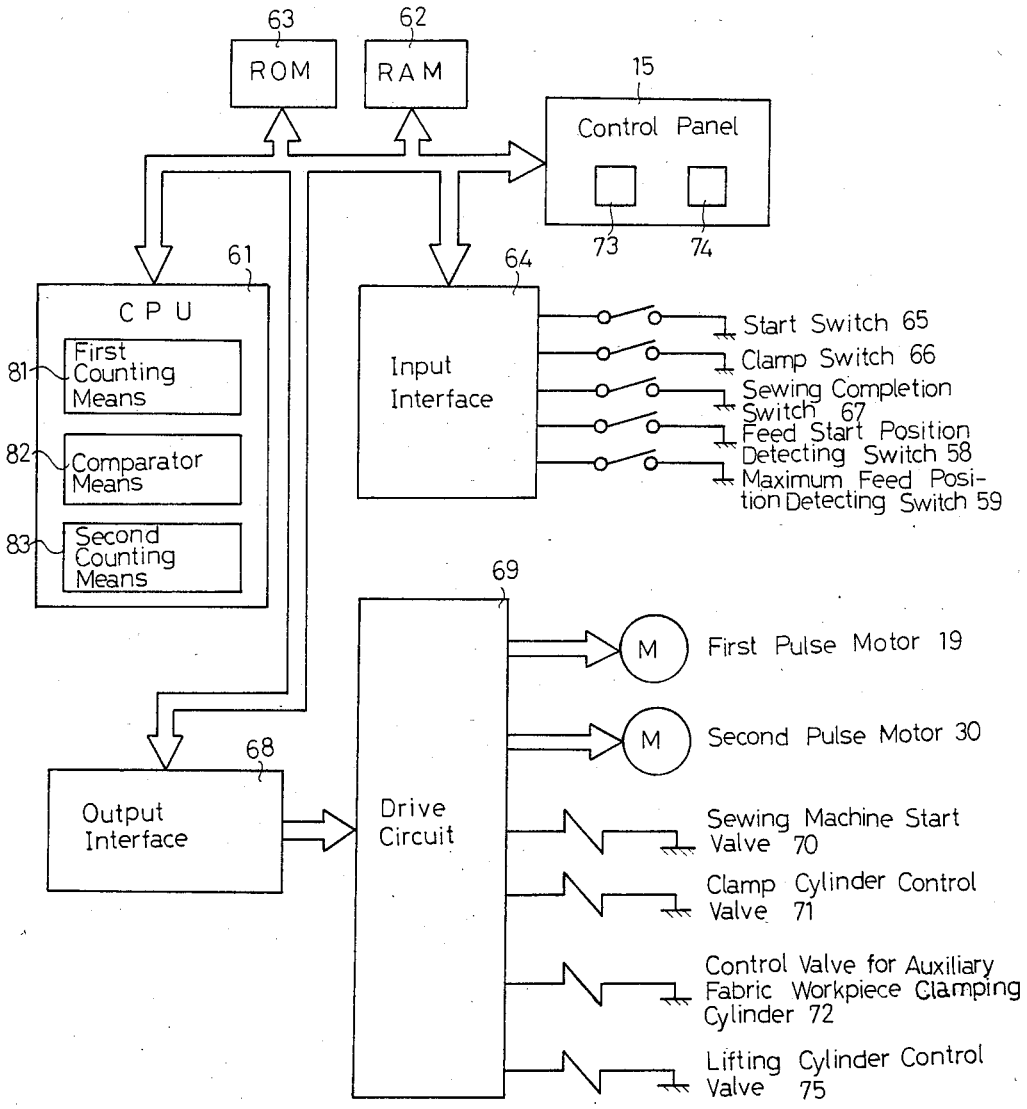
FIG. 6 is a block diagram showing a portion of the electric circuit incorporated in the sewing apparatus.

A description will be made hereinunder as to the electric circuit constituting an essential portion of the button sewing apparatus of the invention, with specific reference to FIG. 6. The aforementioned control panel 15, random access memory (RAM) 62 and a read only memory (ROM) 63 are connected to a central processing unit (CPU) 61 as the control means. The control panel 15 is provided with a button number setting key 73 and a button interval setting key 74. The RAM 62 is adapted to temporarly store the sewing data such as the button number and the button intervals, as the setting keys 73 and 74 are operated by the operator. The ROM 63 is adapted to store the program of operation of the whole apparatus and the sewing data such as the number of buttons and button intervals for standard fabric workpiece, as well as the data concerning the allowed stroke of the fabric workpiece clamping members 16, 17. The RAM 62 and the ROM 63 in combination constitute a memory means.

To the CPU 61 are connected, through an input interface 64, the feed start position detecting switch 58, maximum feed position detecting switch 59, a start switch 65, a clamp switch 66 for setting both clamp cylinders 21 and 31 in operative state, and a sewing completion switch 67 for detecting the completion of one sewing cycle.

A drive circuit 69 is connected to the CPU 61 through an output interface 68. The drive circuit 69 is adapted to drive the first and second pulse motors 19, 30, a sewing machine start valve 70 for controlling the start and stop of the spindle of the sewing machine 4, a clamp cylinder control valve 71 for controlling the operation of the first and second clamp cylinders 21, 31, a valve 72 for controlling the operation of the auxiliary fabric workpiece clamping cylinder 77, and a lifting cylinder control valve 75 for controlling the operation of the lifting cylinder 45 of the delivery device 44.

The CPU 61 is provided with a first counting means 81 for counting the pulses for driving the first pulse motor 19 after the receipt of the signal from the aforementioned feed start position detecting switch 58, thereby detecting a forward travel of the front end clamping member 16 from the feed start position to the instant position. The CPU 61 is provided with a comparator means 82 which is adapted to perform a comparison between the sum of the forward travel data and the button interval data in the RAM 62 and the data concerning the allowed stroke of the clamping members 16 and 17. The CPU 61 also has a second counting means 83 for counting number of the driving pulses for driving the second pulse motor 30 after the input of the signal from the maximum feed position detecting switch 59, thereby detecting a backward travel of the rear end clamping member 17 from the maximum feed position. The function of respective means will become clear from the following description of operation.

Figure 7:
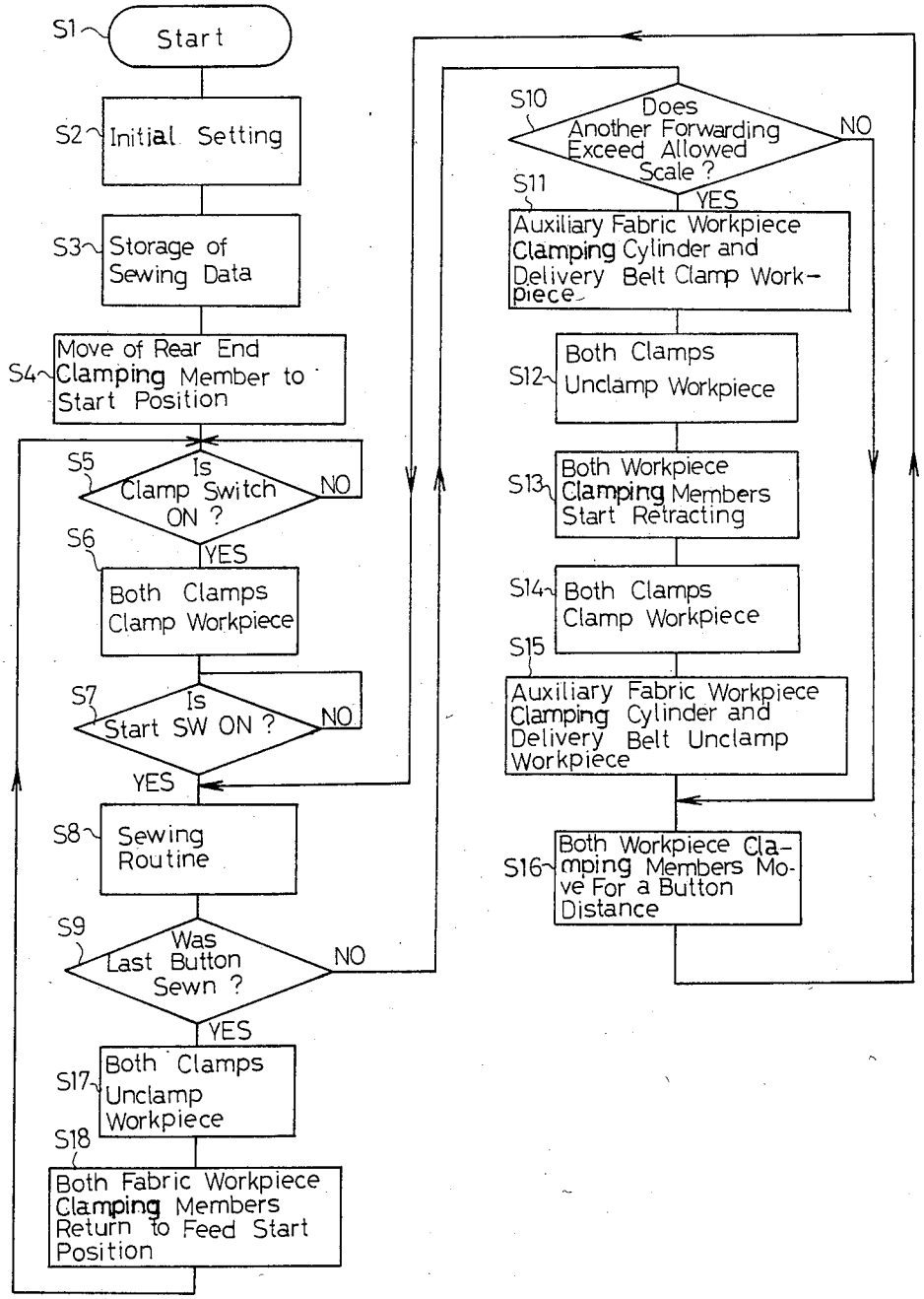
FIG. 7 is a flow chart showing a part of the controlling program in a CPU.

The operation of the button sewing apparatus having the described construction operates in a manner which will be explained hereinunder with specific reference to a flow chart shown in FIG. 7. The program shown in this flow chart proceeds in accordance with the control of the CPU 61.

As the power is turned on in a step S1, an initial setting is performed in a step S2. In this initial setting, as will be seen from FIG. 3, a first pulse motor 19 is driven and the front end clamping member 16 is retracted to the feed start position where it turns the feed start position detecting switch 58. Thereafter, the second pulse motor 30 is driven so that the rear end clamping member 17 is moved forwardly to the position where it turns the maximum feed position detecting switch 59.

Then, the button number and the button interval data are inputted by the operator through the setting keys 73 and 74 on the control panel 15, so that these data is stored in the RAM 62 in a step S3.

Then, in a subsequent step S4, the second pulse motor 30 is driven by pulses the number of which corresponds to the allowed stroke mentioned before, so that the rear end clamping member 17 is moved to the start position on the right end of the work table 2.

Figure 4:
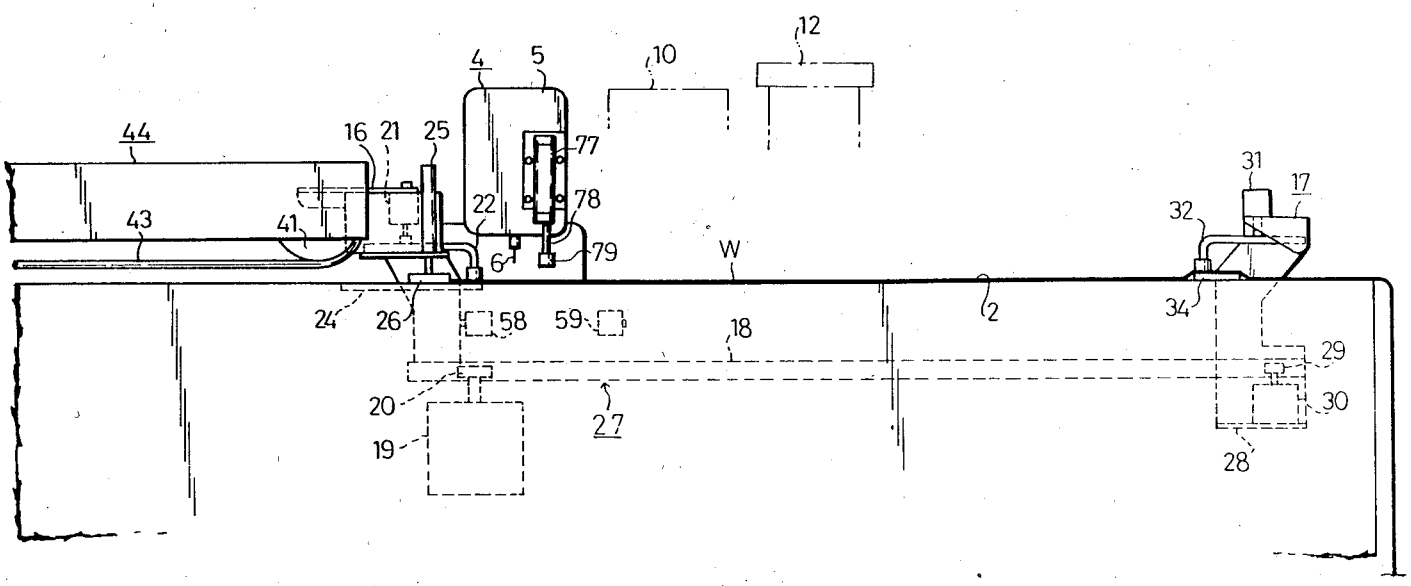
FIG. 4 is a fragmentary front elevational view of the sewing apparatus illustrating the positions of the clamping members at the time of start of the feed.
Figure 5:
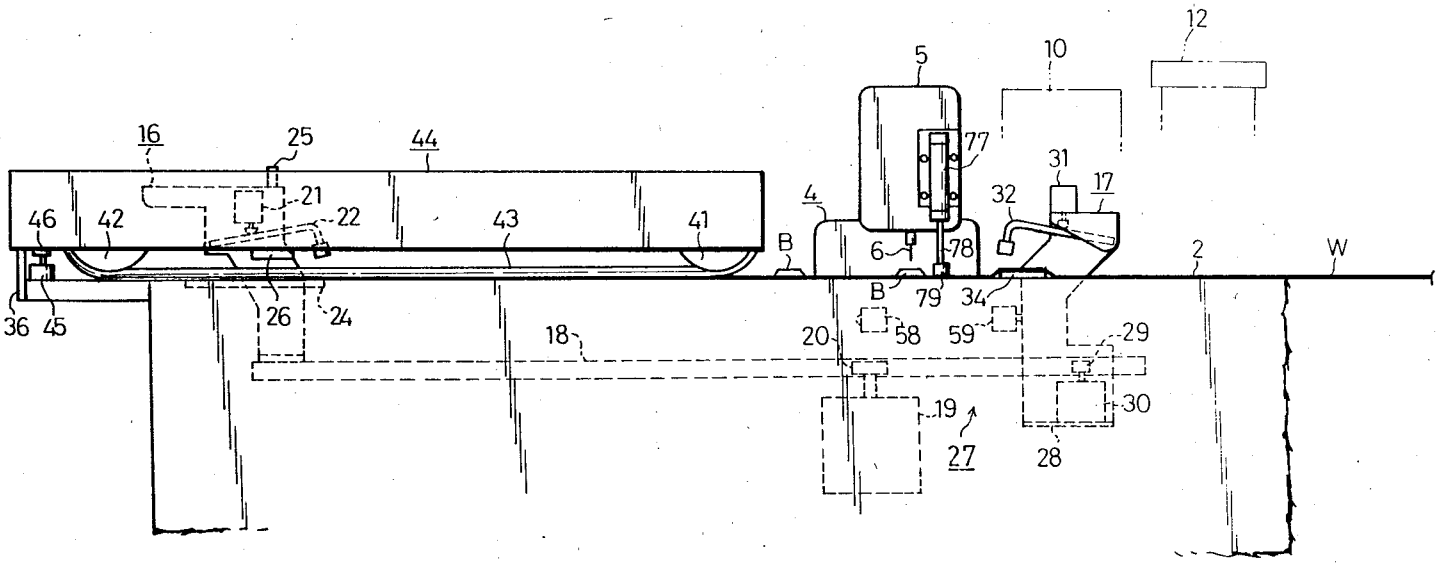
FIG. 5 is a fragmentary front elevational view of the sewing apparatus illustrating auxiliary fabric workpiece clamping means holding the fabric workpiece.

Then, as the turning on of the clamp switch 66 is confirmed in a step S5, a valve 71 for controlling the operation of the first and second clamp cylinders 21 and 31 is opened in a step S6. Consequently, the front end clamp 22 and the rear end clamp 32 retain the front and rear ends of the fabric workpiece W, as will be seen from FIGS. 1 and 4.

As the turning on of the start switch 65 is confirmed in step S7, the process proceeds to a sewing routine in a step S8, so that the button B is sewed on the first sewing portion P of the fabric workpiece W by a cooperation between the needle 6 and the button clamping arms 8.

In the next step S9, a judgement is made as to whether the button B has been sewed on the last fabric workpiece W and, if the result is NO, the process proceeds to a step S10. In this step S10, a judgement is made by the comparator means 82 as to whether the forward travel of the rear end clamping member 17 from the feed start position to the instant position exceeds the aforesaid allowed stroke, if both clamping members 16 and 17 are moved by a distance equal to the button interval for bringing the next sewing portion P to the reciprocating path of the needle. This judgement is conducted on the basis of the relationship between the forward travel data (X) counted by the first counting means 81 and stored in the RAM 62, the button interval data (Y) stored in the RAM 62 or the ROM 63, and the allowed stroke data (Z) for both clamping members 16, 17 stored in the ROM 63. More specifically, the answer of the judgement is NO when the condition of $[(X+Y) \leqq Z]$ is met and YES when the condition of $[(X+Y) > Z]$ is met. Therefore, when the sewing is completed only with the first button B, the answer is NO. In this case, in a step S16, the first pulse motor 19 is driven by pulses of a number corresponding to the button interval, so that the next sewing portion P is fed to the reciprocating path of the needle by a distance corresponding to the movement of the both clamping members 16 and 17. Then, the process returns to the sewing routine of the step S8 in which the second button B is sewed.

In the case of the processing of a comparatively short fabric workpiece W such as child's clothes or a shirt, the required amount of feed of the fabric workpiece W by the clamping members 16 and 17 falls within the range of the allowed stroke, so that the result of judgement in the step S10 in each sewing cycle is NO. In consequence, the operations of the steps S8 and S10 are successively repeated thereby sewing the buttons B to the successive sewing portions. After the completion of button sewing to all sewing portions P, the process proceeds from the step S9 to the step S17, so that the valve 71 is closed thereby allowing the front and rear end clamps 22 and 32 to release both ends of the workpiece W. Simultaneously with the release, the delivery device 44 and the stacking device 48 are started so that the fabric workpiece W is delivered to the outside of the work table 2 and placed on the mounting table 53. Then, concurrently with the placement of the fabric workpiece W on the mounting table 53, the clamping members 16 and 17 are returned to the initial positions and the process is returned to the step S5 thereby to effect the button sewing on the next fabric workpiece W.

In the case of sewing of a comparatively long fabric workpiece W such as a long dress, white robe or a negligee, the required amount of feed of the fabric workpiece W exceeds the allowed stroke for both clamping members 16 and 17, so that the answer YES is obtained in the step S10 before the completion of sewing of buttons to all sewing portions In this case, the vlave 72 is opened in the step S11 and the piston rod 78 of the auxiliary fabric workpiece clamping cylinder 77 is extended to allow the retainer 79 to retain and hold the portion of the fabric workpiece W near the reciprocating path of the needle. Simultaneously, the valve 75 is closed so that the piston rod 46 of the delivery device 44 is retracted so that the delivery belt 43 retaines and holds the front end of the fabric workpiece W. Immediately after the hoding of the front end of the workpiece W, the valve 71 is closed in a step S12, so that both clamps 22 and 32 unclamp the fabric workpiece W.

Then, in a step S13, both fabric workpiece clamping members 16 and 17 are retracted towards the feed start positions without holding the fabric workpiece W. The amount of backward travel of the rear end clamping member 17 is detected by the second counting means 83 and, when the counted value reaches a value which is calculated on the basis of the number of remaining buttons and the button interval, the backward movement of both clamping members 16 and 17 is ceased precisely at positions corresponding to the rear end of the fabric workpiece W. In a step S14, the valve 71 is opened so that the clamps 22 and 32 of both fabric workpiece clamping members 16 and 17 clamp the fabric workpiece W again at the returned position thereof. Subsequently, in a step S15, the auxiliary fabric workpiece clamping cylinder 77 and the lifting cylinder 46 are reversed so that the fabric workpiece W is released from the retainer 79 and the delivery belt 43. Then, in a step S16, the first pulse motor 19 is driven to move both clamping members 16 and 17 to move by a distance corresponding to the button interval, so that the sewing portions p beyond the allowed stroke are successively brought to the reciprocating path of the needle of the sewing machine 4. Then, the step S8 is executed to sew the buttons to successive sewing portions P.

After the sewing of all buttons B to the long fabric workpiece W, the answer YES is obtained in the judgement in the step S9, so that the clamps 22 and 32 of both clamping members 16 and 17 releases the fabric workpiece W in a step S17. Then, in a step S18, both clamping members 16 and 17 are returned to the feed start positions and the process is returned to the step S5 thereby to start the sewing on the next fabric workpiece.

The invention is not limited to the button sewing apparatus as described, and is applicable also to sewing apparatus which is used for continuously forming button hole stitches at a plurality of sewing portions of a fabric workpiece.

As has been described, the apparatus of the invention is constructed such that, when the required amount of feed of the fabric workpiece exceeds the allowed stroke of the fabric workpiece clamping members from the feed start position to the maximum feed position, the fabric workpiece clamping members reaching the maximum feed positions once release the fabric workpiece and return towards the feed start positions while auxiliary fabric workpiece clamping means retaines and holds the fabric workpiece, and then the fabric workpiece clamping members feed the fabric workpiece again. It is, therefore, possible to continuously and precisely form stitches on a plurality of sewing portions of a long fabric workpiece in a short time, without requiring any increase in the size of the apparatus as a whole.

What is claimed is:

1. A sewing apparatus for continuously forming stitches on a plurality of sewing portions comprising:

a work table;

a sewing machine adapted to sew buttons on a fabric workpiece on said work table or to form buttonhole stitches on said fabric workpiece;

fabric workpiece clamping means movable along the upper surface of said work table and capable of holding and releasing said fabric workpiece;

a feed driving mechanism adapted to bring said clamping means from a feed start position to a maximum feed position such as to bring a plurality of sewing portions of the fabric workpiece successively to a reciprocating path of a needle of said sewing machine;

auxiliary fabric workpiece clamping means capable of holding and releasing said fabric workpiece on said work table independently of said fabric workpiece clamping means;

detecting means adapted for detecting a forward travel of said fabric workpiece clamping means from said feed start position to an instant position;

memory means for storing data concerning the number of said sewing portions and the intervals thereof; and control means for controlling said fabric workpiece clamping means and said auxiliary fabric workpiece clamping means such that, when the sum of the forward travel of said fabric workpiece clamping means and the interval between successive sewing portions exceeds an allowed stroke of said fabric workpiece clamping means from the feed start position to the maximum feed position, said fabric workpiece clamping means once release said fabric workpiece and return from the instant position towards the feed start position while said auxiliary fabric workpiece clamping means hold said fabric workpiece and then hold said fabric workpiece again at a returned position thereof.

2. A sewing apparatus for continuously forming stitches on a plurality of sewing portions according to claim 1, wherein said fabric workpiece clamping means include a front end clamping member for clamping and releasing the front end of said fabric workpiece on said work table in the direction of feed and a rear end clamping member for clamping and releasing a rear end of said fabric workpiece.

3. A sewing apparatus for continuously forming stitches on a plurality of sewing portions according to claim 2, wherein said feed driving mechanism includes a connecting member for connecting said front and rear end clamping members for movement as a unit with each other, and a first driving source adapted to reciprocally drive said connecting member in the direction of the feed.

4. A sewing apparatus for continuously forming stitches on a plurality of sewing portions according to claim 3, wherein said forward travel detecting means have a first detector for detecting the feed start position of said front end clamping member and a first counting means for counting the amount of driving by said first driving source.

5. A sewing apparatus for continuously forming stitches on a plurality of sewing portions according to claim 3, wherein said rear end clamping member is supported for movement relatively to said connecting member, while said feed driving mechanism includes a second driving source which drives said rear end clamping member between said feed start position and said maximum feed position independently of said front end clamping member.

6. A sewing apparatus for continuously forming stitches on a plurality of sewing portions according to claim 5, further comprising means for detecting a backward travel of said rear end clamping member from the maximum feed position towards said feed start position, and means for stopping said rear end clamping member at any desired position.

7. A sewing apparatus for continuously forming stitches on a plurality of sewing portions according to c1aim 6, wherein said detecting means for detecting the backward travel of said rear end clamping member include a second detector for detecting the maximum feed position of the rear end clamping member and a second counting means for counting the amount of driving by said second driving source.

8. A sewing apparatus for continuously forming stitches on a plurality of sewing portions according to claim 1, wherein said auxiliary fabric workpiece clamping means include a first auxiliary fabric workpiece clamping member capable of holding and releasing a front end of said fabric workpiece on said work table in the direction of feed, and a second auxiliary fabric workpiece clamping member capable of holding and releasing a rear end of said fabric workpiece.

9. A sewing apparatus for continuously forming stitches on a plurality of sewing portions according to claim 8, wherein said first auxiliary fabric workpiece clamping member is a delivery belt disposed at a position ahead of the reciprocating path of the needle of said sewing machine as viewed in the direction of feed of said fabric workpiece, such as to be able to move reciprocatingly between a first position where it contacts said fabric workpiece on said work table and a second position spaced from said first position, said delivery belt being adapted to deliver, when it is in said first position, said fabric workpiece to the outside of said work table after the stitches have been formed on all the sewing portions.

10. A sewing apparatus for continuously forming stitches on a plurality of sewing portions according to claim 8, wherein said second auxiliary fabric workpiece clamping member is an auxiliary fabric workpiece clamping cylinder provided on said sewing machine.

11. A sewing apparatus for continuously forming stitches on a plurality of sewing portions according to claim 2, wherein said front end clamping member is provided with a positioning member to position the front edge of said fabric workpiece at a position ahead of the reciprocating path of the needle of said sewing machine.

12. A sewing apparatus for continuously forming stitches on a plurality of sewing portions comprising:

a work table;

a sewing machine adapted to sew buttons on a fabric workpiece on said work table or to form buttonhole stitches on said fabric workpiece;

fabric workpiece clamping means movable along the upper surface of said work table and capable of holding and releasing said fabric workpiece;

a feed driving mechanism adapted to bring said clamping means from a feed start position to a maximum feed position such as to bring a plurality of sewing portions of the fabric workpiece succesively to a reciprocating path of a needle of said sewing machine;

delivery means disposed at a position ahead of the reciprocating path of the needle of said sewing machine as viewed in the direction of feed of said fabric workpiece, such as to be able to move reciprocatingly between a first position where they contact said fabric workpiece on said work table and a second position spaced from said first position, said delivery means being adapted to deliver, when they are in said first position, said fabric workpiece to the outside of said work table after the stitches have been formed on all the sewing portions;

an auxiliary fabric workpiece clamping member disposed on the rear side of said delivery means as viewed in the direction of feed of said fabric workpiece and capable of holding and releasing said fabric workpiece independently of said fabric workpiece clamping means;

detecting means adapted for detecting a forward travel of said fapric workpiece clamping means from the feed start position to an instant position;

memory means for storing data concerning the number of said sewing portions and the intervals thereof; and control means for controlling said fabric workpiece clamping means, said delivery means and said auxiliary fabric workpiece clamping member such that, when the sum of the forward travel of said fabric workpiece clamping means and the interval between successive sewing portions exceeds an allowed stroke of said fabric workpiece clamping means from the feed start position to the maximum feed position, said fabric workpiece clamping means once release said fabric workpiece workpiece and return from the instant position towards the feed start position while said delivery means and said auxiliary fabric workpiece clamping member hold said fabric workpiece and then hold said fabric workpiece again at a returned position thereof.

* * * * *